US005816018A

United States Patent [19]

Bois

[11] Patent Number: 5,816,018

[45] Date of Patent: Oct. 6, 1998

[54] MACHINE FOR AUTOMATICALLY FORMING, FILLING, AND CLOSING BAGS HAVING TRANSVERSE CLOSURE RIBS

[75] Inventor: Henri Bois, Neuilly-sur-Seine, France

[73] Assignee: Flexico-France, Henonville, France

[21] Appl. No.: 808,045

[22] Filed: Feb. 27, 1997

[30] Foreign Application Priority Data

Feb. 27, 1996 [FR] France ..... 96 02390

[51] Int. Cl.[6] ..... B65B 51/04; B65B 61/18

[52] U.S. Cl. ..... 53/133.4; 53/139.2; 53/552; 493/213

[58] Field of Search ..... 53/133.4, 139.2, 53/552, 551; 493/213

[56] References Cited

U.S. PATENT DOCUMENTS

| | | | |
|---|---|---|---|
| 3,838,549 | 10/1974 | Pepmeier . | |
| 4,355,494 | 10/1982 | Tilman | 53/139.2 X |
| 4,617,683 | 10/1986 | Christoff . | |
| 4,655,862 | 4/1987 | Christoff et al. . | |
| 4,666,536 | 5/1987 | Van Erden et al. . | |
| 4,701,361 | 10/1987 | Van Erden . | |
| 4,709,398 | 11/1987 | Ausnit . | |
| 4,844,759 | 7/1989 | Boeckmann . | |
| 4,878,987 | 11/1989 | Ven Erden . | |
| 4,894,975 | 1/1990 | Ausnit . | |
| 4,909,017 | 3/1990 | McMahon et al. . | |
| 4,929,225 | 5/1990 | Ausnit et al. . | |
| 5,111,643 | 5/1992 | Hobock . | |
| 5,519,982 | 5/1996 | Herber et al. | 53/139.2 X |

FOREIGN PATENT DOCUMENTS

| | | |
|---|---|---|
| 0 528 721 | 2/1993 | European Pat. Off. . |

*Primary Examiner*—Linda Johnson
*Attorney, Agent, or Firm*—Schwartz & Weinrieb

[57] ABSTRACT

A machine for making film packages that includes complementary closure ribs, the machine including a drive for conveying closure ribs transversely with respect to the film and comprising in combination: a rectilinear guide superposed relative to the film and extending transversely relative thereto, the guide being designed to accurately position at least one closure rib transversely over the film; and a device for grasping the leading end of the closure rib and capable of moving transversely along the guide to convey the closure rib therealong by pulling on the leading end of the closure rib.

21 Claims, 3 Drawing Sheets

MACHINE FOR AUTOMATICALLY FORMING, FILLING, AND CLOSING BAGS HAVING TRANSVERSE CLOSURE RIBS

FIELD OF THE INVENTION

The present invention relates to the field of bags or sachets that include complementary closure ribs adapted to enable the user to open and close the bags successively at will.

More precisely, the present invention relates to the field of machines for making such bags, in particular machines adapted to automatically form, fill, and close packages made from on film, in particular film made of thermoplastic material, and including complementary closure ribs, for example complementary male and female closure ribs.

BACKGROUND OF THE INVENTION

Machines of the afore-noted type are often referred to as "Form, Fill, and Seal machines" or by the abbreviation FFS machines.

Numerous machines of this type have already been proposed (see for example documents EP-A-528721 and U.S. Pat. No. 4,894,975).

Most such machines have a former which is fed with the film in the plane state from a suitable pay-out means and which delivers the film shaped in the form of a tube; a filler chute opening out into the former and consequently into the tube; means for conveying closure ribs and fixing them to the film; longitudinal heat-sealing means for closing the tube longitudinally; and means suitable for sequentially generating a first transverse line of sealing before a product is placed in the tube by means of the filler chute, and a second transverse line of sealing after the product had been placed in the tube, thereby closing the package around the product.

Still more precisely, most machines that have been proposed in the past are designed to receive closure ribs in the longitudinal direction, that is parallel to the travel direction of the film. However, such longitudinal-rib machines suffer from the drawback of limiting the height of the resulting bags. The height is equal to half the circumference of the former. Also, packages obtained from such machines are sometimes not entirely leakproof. This can result in particular from the fact that the transverse heat-sealing means are prevented from operating properly by the extra thickness as constituted by the longitudinal ribs.

Numerous attempts have been made to improve this situation, by placing the closure ribs not longitudinally, that is parallel to the travel direction of the film, but transversely, that is perpendicular to the travel direction of the film.

The earliest attempt on these lines and known to the inventors is described in patent documents U.S. Pat. Nos. 4,617,683 and 4,655,862. Those documents are approximately ten years old and they propose two solutions for conveying the ribs transversely onto the film while it is in the plane state, that is before the film reaches the former. The first solution consists in displacing lengths of closure ribs laterally by means of drive wheels placed laterally beside the moving film, in combination with a transversely displaceable suction head. The second solution consists in placing the closure ribs on the film by means of a rotary barrel provided with pneumatically-controlled temporary holding means.

Those attempts were initially promising, however, in the end they did not prove satisfactory and they have been abandoned by the those skilled in the art. In particular, it has been observed that the means described in the above-mentioned documents are not suitable for ensuring that the ribs are always placed in an accurately rectilinear manner on the film. Consequently, it is often difficult to make the complementary ribs cooperate.

Other solutions have therefore been proposed in attempts to overcome the drawbacks that result from the means described in the above-mentioned documents.

By way of example, patent document U.S. Pat. No. 4,666,536 proposes winding a portion of the film on a mandrel and conveying a length of closure rib onto the wound portion of film, the length of the rib extending across the width of the film and being conveyed by means of a heating tunnel that serves to fix the ribs. The means described in that document theoretically present the advantage of allowing shaping to be performed continuously. Nevertheless such turns out to be very complex and difficult to implement.

In order to form a film that is provided sequentially with complementary closure ribs, patent document U.S. Pat. No. 4,701,361 proposes extruding a tubular film provided with helical closure ribs that may be extruded or that may be added on, and then cutting the tubular film helically so as to obtain a strip provided with uniformly distributed transverse ribs.

To reduce the length of the rib deposited on the film, and consequently improve the positioning of the ribs, patent document U.S. Pat. No. 4,878,987 proposes feeding the ribs not by means of a lateral feed as described in patent documents U.S. Pat. Nos. 4,617,683 and 4,655,862, but from two rib feeds disposed upon respective sides of the film that is to form the bags. Thus, each of the two lengths of ribs moves over the film from a respective one of the two sides supplies no longer extend over the entire width of the film, but only over half of the width thereof.

Subsequently, patent document U.S. Pat. No. 4,844,759 has proposed two other solutions. The first such solution consists in driving the closure ribs by means of an endless belt over a bracket that overlies the film and that pivots through 180°, so as to overturn the closure ribs onto the film. In this way, the ribs are initially conveyed along the bracket with their relief directed towards the film, after which they are turned over so that the relief faces away from the film for the purpose of being fixed onto the film. The second solution consists in conveying the ribs transversely on a shoe that overlies the film and then in lowering the shoe against the film so as to fix the closure ribs in place.

After observing that none of the techniques described in the above-mentioned patent documents gives satisfactory results patent, document U.S. Pat. No. 5,111,643 proposes acting in a completely different way which consists not in fixing the closure ribs on the film prior to bringing the film to the former as described in the above-specified patent documents, but in initially forming the film into a tube on the former tube, and then in placing the closure ribs on the tubular film. To this end patent, document U.S. Pat. No. 5,111,643 proposes a complex installation that includes a chute opening out at the base of the former for the purpose of conveying the closure ribs as carried by a support strip, together with a chute for removing the support strip.

OBJECTS AND SUMMARY OF THE INVENTION

An object of the present invention is to improve machines for shaping film-based packages that include complementary closure ribs.

According to the present invention, this object is achieved by a machine including means for conveying closure ribs transversely relative to the film and comprising in combination:

a rectilinear guide superposed relative to the film and extending transversely relative thereto, the guide being designed to accurately position at least one closure rib transversely over the film; and means for grasping the leading end of the closure rib and being capable of moving transversely along the guide so as to convey the closure rib therealong by pulling on the leading end of the closure rib.

The invention is preferably applied to automatic machines for forming, filling, and closing film-based packages of the conventional type and comprising a former that is fed with the film in the plane state coming from a suitable pay-out means and that delivers the film shaped into a tube; a filler chute that opens out into the former and consequently into the tube; means for conveying closure ribs transversely relative to the film before the film reaches the former and for fixing the ribs to the film; longitudinal heat-sealing means for closing the tube longitudinally; and means suitable for sequentially generating a first transverse line of sealing before a product is put into the tube by means of the filler chute, and a second transverse line of sealing when the product has been put into the tube, so as to close the packaging around the product.

Thus, the present invention is contrary to the teachings associated with the means described in the first patent documents U.S. Pat. Nos. 4,617,683 and 4,655,862. Whereas numerous designers have held the opinion that the means described in those patent documents were incapable of providing satisfactory results or products, thereby giving rise to the numerous subsequent proposals noted above, the present inventors, after numerous experiments, have found that a solution based on the means described in those patent documents U.S. Pat. Nos. 4,617,683 and 655,862 can indeed provide satisfactory results or products, providing they include the improvement consisting in combining a rectilinear guide with a grasping means that operates by pulling the closure ribs.

In another advantageous characteristic of the invention, the means for conveying the closure ribs are adapted to fix to the film one of two mutually engaged complementary ribs each of a length that is approximately equal to half the width of the film, and means are also provided which are suitable for fixing the second closure rib to the inside wall of the film once the film has been shaped into a bag, after the bag has been filled, and while the bag is being finished.

To facilitate these operations of fixing closure ribs in two stages, it is preferable for the two closure ribs to be carried by support strips of different widths.

BRIEF DESCRIPTION OF THE DRAWINGS

Other characteristics, objects, and advantages of the present invention will appear upon reading the following detailed description with reference being made to the accompanying drawings given by way of a non-limiting example, in which like or corresponding parts are designated by like or similar reference characters throughout the several views, and wherein.

DETAILED DESCRIPTION OF THE ILLUSTRATED EMBODIMENTS

Figure 1:
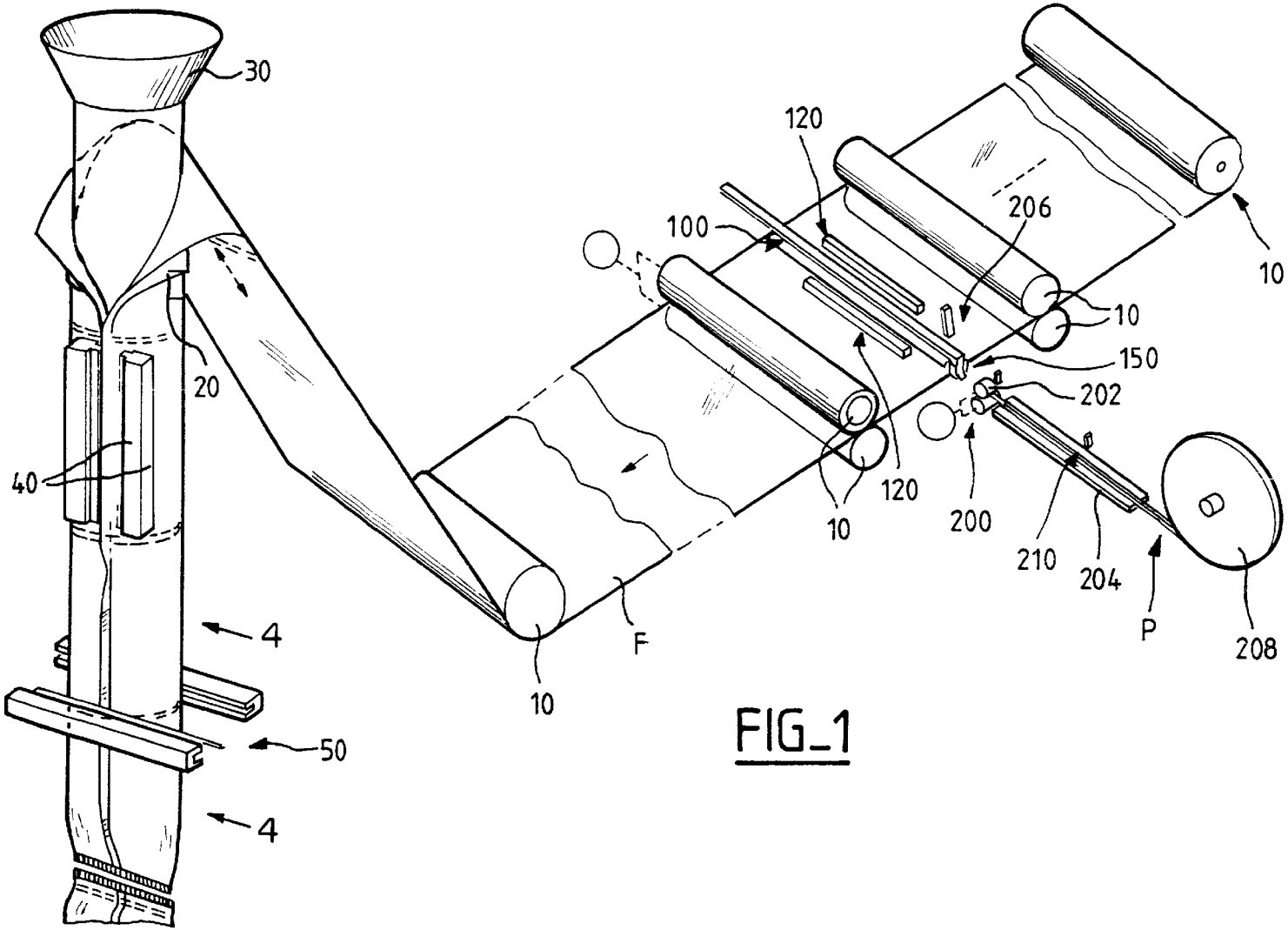
FIG. 1 is a diagrammatic perspective view of a machine of the invention for automatically forming, filling, and closing bags.

FIG. 1 shows the conventional general structure of a machine for automatically forming, filling, and closing bags that include complementary closure ribs, the machine comprising:

means 10 for feeding film F;

a former 20;

a filler chute 30;

longitudinal heat-sealing means 40; and transverse heat-sealing means 50 that also serve to separate formed bags.

Since this general structure is known, it is not described in detail below.

However, as mentioned above, according to the invention, in order to convey the closure ribs P properly and transversely over the film F prior to the film reaching the former 20, provision is made for:

a rectilinear guide 100 overlying the film F, extending transversely to the travel direction thereof, and located upstream from the former 20; the guide 100 is designed to position at least one closure rib P accurately and transversely above the film F; and means 150 for grasping the leading end of the closure rib P; which grasping means 150 is suitable for moving transversely along the guide 100 so as to move the closure rib P therealong by pulling on the leading end of the closure rib P.

The rectilinear guide 100 can be implemented in various different ways.

In a first embodiment, the guide 100 is constituted by a rigid rectilinear channel having a section that is complementary to at least a portion of the closure ribs P.

In a second embodiment, the rectilinear guide 100 is constituted by a channel formed by two pivoting jaws, which in the closed position receive the rib P moved by the means 150, but which are capable of opening so as to facilitate subsequent placing of ribs P on underlying films F.

The grasping means 150 can also be implemented in various different ways.

As shown diagrammatically in FIG. 1, the grasping means 150 are preferably formed by a clamp system controlled to close in order to grasp the leading end of a rib P so as to move it along the rectilinear guide 100, and then to open so as to release the rib P before returning to the initial grasping position as shown diagrammatically in FIG. 1.

In a variant embodiment, the grasping means 150 may be constituted by a suction head.

Naturally, provision is preferably made for means that displace the grasping means 150 transversely and in synchronism with displacement of the film F.

Auxiliary means are preferably provided for conveying the ribs P: drive wheels 200 and 202; a guide 204 for the ribs P upstream from the film F; means 206 for cutting the ribs P into lengths (the ribs P being preferably fed from a supply in the form of a reel 208); and a position sensor 210.

The closure ribs P are fixed to the film F by any appropriate means, advantageously using heat-sealing jaws associated with the rectilinear guide 100, as represented by reference 120 in FIG. 1.

The ribs P can be put into place on the film F in various different ways.

Figure 3:
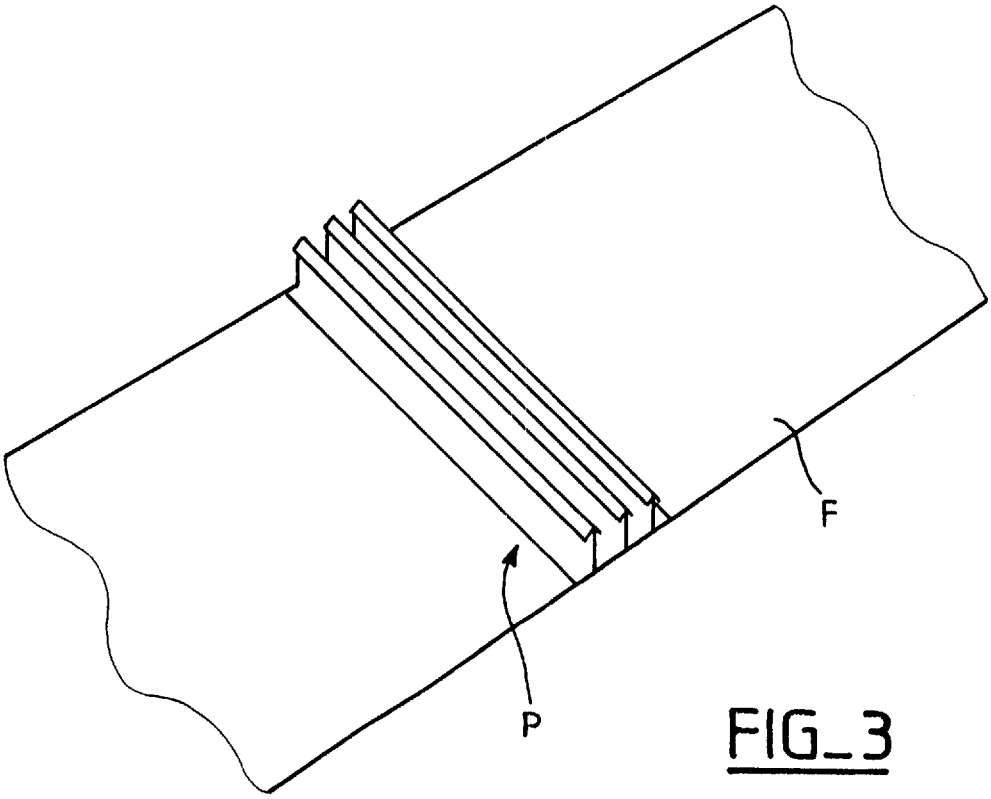

In a first variant, the system is adapted to place the closure ribs P so as to cover the entire width of the film F, the ribs P being fixed to the film F along their full length, as represented in FIG. 3, and coming into engagement solely after the tubular film has been folded over and compressed after the bag has been filled, while the bag is being finished.

Figure 2:
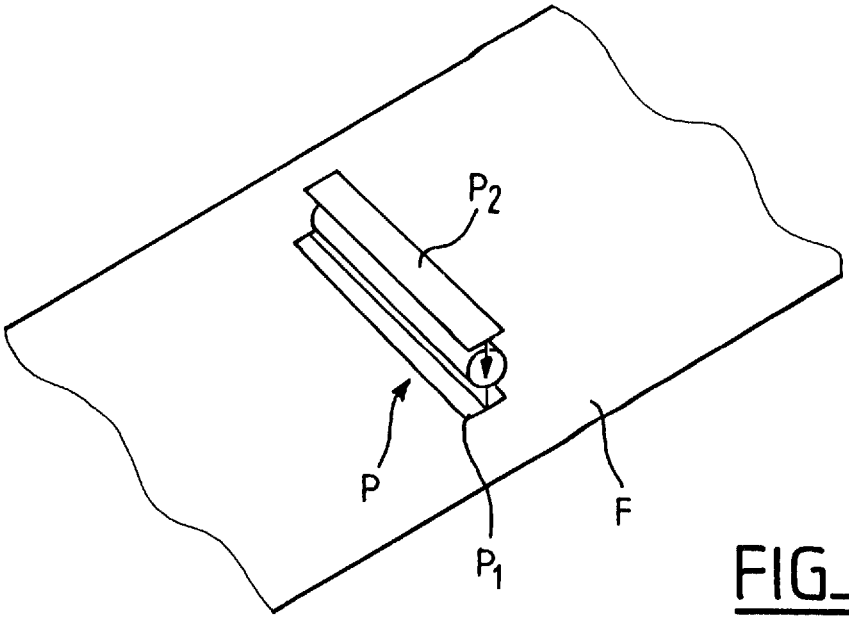
FIGS. 2 and 3 are diagrams showing two variant implementations of the invention.

However, in another variant, as represented in FIG. 2, the system can be adapted to place a pair of mutually-engaged ribs P directly upon the film F where by the ribs P cover only half of the width of the film F, one of the two ribs, P1, being adjacent to the film F and being fixed thereto at the station for positioning the ribs P by means of the heat-sealing jaws 120, while the superposed second rib P2 is fixed to the inside of the bag while the bag is being finished after it has been filled. Under such circumstances, the second rib P2 can be heat-sealed to the film F by means of the heat-sealing jaws 50 or by means of additional transverse heat-sealing jaws 52, as shown diagrammatically in FIG. 4.

Figure 4:
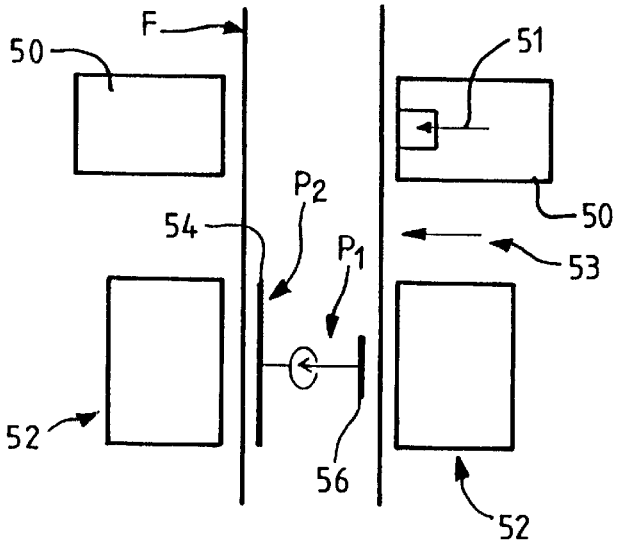
FIG. 4 is a vertical section view of the machine of FIG. 1 as taken on plane referenced 4—4 in FIG. 1.

In the context of this second solution, and as shown in FIG. 4, it is preferable for the support strip 54 of the second rib P2 to be wider than the support strip 56 of the first rib P1 so as to make the second heat-sealing operation easier.

With the rib P extending transversely across the film F before the film reaches the former 20, it is preferable to provide means that make it easier to pass through the former 20.

To this end, it is possible either to place the former 20 off-center relative to the vertical axis of the machine so as to allow the transverse closure ribs P to pass, or else to leave sufficient clearance in the former 20.

Figure 5:
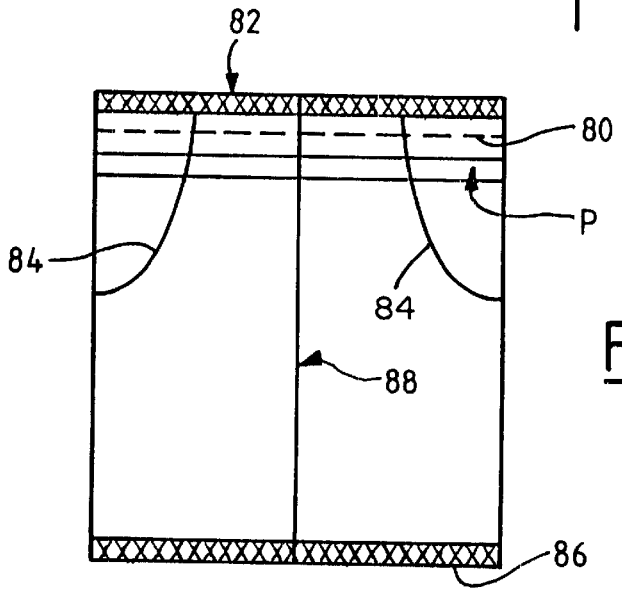
FIG. 5 is a side view of a bag of the invention.
Figure 6:
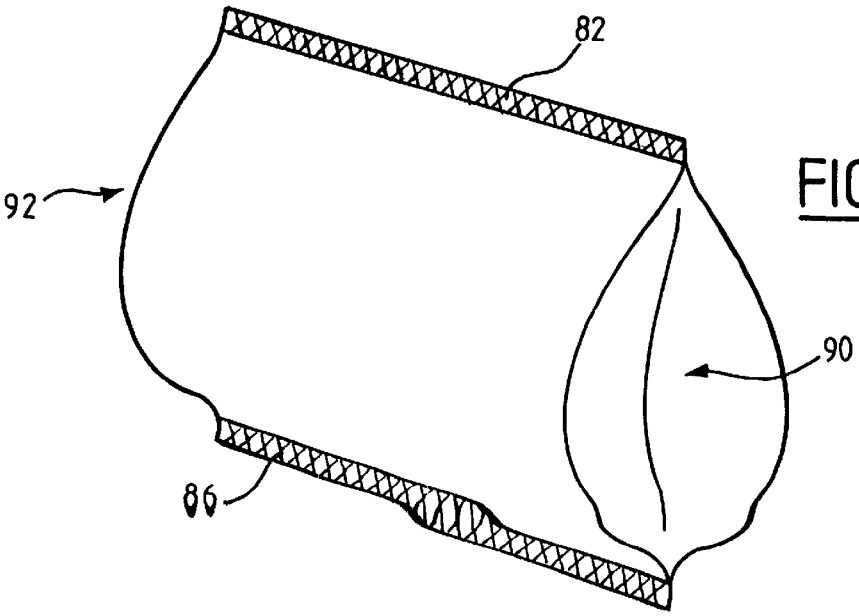
FIG. 6 is a perspective view of a bag of the invention that has gussets.

Also, the resulting bags can themselves be of numerous different kinds, and special mention may be made of the following:

- as shown in FIG. 5, is it possible to make precut lines 80 between the closure ribs P and the second transverse line of sealing 82 (which precut lines can be made in a conventional manner by means of toothed knife blades associated with the transverse heat-sealing jaws 50);
- "sloping-shoulder" or "coat-hanger" type curved longitudinal lines of sealing can be made, as shown at 84 in FIG. 5, in particular for applications that package a liquid; such lines of sealing 84 are generally rounded in shape, being convex towards the inside of the bag and converging towards the top thereof which coincides with the second transverse line of sealing 82; in FIG. 5, 86 designates the first transverse line of sealing and 88 the longitudinal line of sealing made using jaws 40 for the purpose of interconnecting the longitudinal edges of the film F; the "coat-hanger" lines of sealing 84 are preferably symmetrical about a midplane of the bag extending transversely relative to the lines 82 and 86 and they are made by means of heat-sealing jaws of complementary shapes; and
- bags can be made that have lateral gussets 90 and 92, as shown in FIG. 6, by forming longitudinal folds in the film F before it penetrates into the former 20.

In FIG. 4, reference 51 designates a cutting tool associated with the transverse heat-sealing jaws 50 for the purpose of separating finished bags, and reference 53 designates a cutting tool suitable for being used to make the precut line 80.

The closure ribs P can themselves be implemented in numerous different ways.

As shown in FIG. 2, they can be constituted by complementary asymmetrical male and female ribs P1 and P2.

As shown in FIG. 3, they may equally be constituted by ribs P of constant section and suitable for mutual engagement after being folded over.

Means are preferably provided, for example in the form of two-material ribs P or equivalent means, enabling a melting temperature to be defined for the outside surfaces of the support strips 54 and 56 that is lower than the melting temperature of the inside surfaces thereof.

The film F may also be implemented in numerous ways. It may be constituted by a flexible film of plastic material comprising one or more layers, and optionally coated, where appropriate, with a metal layer.

The present invention provides numerous advantages over systems that exist in the prior art, and particular mention may be made of the following advantages in that:

- by putting the closure ribs P into place under traction, and by doing so on a guide 100, it is possible to position the ribs P very accurately across the width of the film F and to do so in the rectilinear state;
- the invention is very easy to implement; and
- the resulting bag is leakproof (since the closure ribs extend parallel to the transverse heat-sealing means 50 they do not interfere with the operation thereof).

Naturally, the present invention is not limited to the particular embodiments described above, but it extends to any variant coming within the spirit of the invention as defined within the appended claims.

Thus, as described above, the invention is applicable to machines for automatically forming, filling, and closing film-based packages.

However, the invention can also be applied to machines for preparing films that are fitted with ribs, wherein such rib-fitted films are subsequently fed to conventional machines for automatically forming, filling, and closing packages.

In the description above, the grasping means are constituted either by a clamp system or by a suction head. In another variant, the grasping means may be constituted by a needle carried by drive means adapted firstly to move the needle with reciprocating motion, either in translation or by pivoting, towards and away from the guide 100 so as to engage the rib P when in the position close to the guide, and to move the needle back and forth along the guide 100. More precisely, the drive means are adapted firstly to move the needle towards the feed end of the guide 100 so as to engage the free end of the rib P coming from the supply 208, secondly to move the needle along the guide 100 while keeping the needle engaged with the rib P so as to move the rib P by applying traction to its leading end, thirdly to move the needle away from the guide 100 so as to release the rib P at the end of the needle/rib feed stroke, and fourthly to return the needle back along the guide 100 towards the feed end thereof while keeping the needle away from the rib P, prior to repeating the drive cycle starting from the first-mentioned step above, but with the next succeeding length of rib P.

Obviously, many modifications and variations of the present invention are possible in light of the above teachings. It is therefore to be understood that within the scope of the appended claims, the present invention may be practiced otherwise than as specifically described herein.

I claim:

1. A machine for making film packages that include complementary closure ribs, comprising:

means for conveying a film in a longitudinal direction;

rectilinear guide means, overlying said film, having a predetermined configuration, and extending transversely with respect to said longitudinal direction in which said film is conveyed, for accurately positioning at least one closure rib transversely with respect to said film; and means for grasping a leading end portion of said at least one closure rib and having a predetermined configuration which is complementary to said predetermined configuration of said rectilinear guide means for moving transversely along and in contact with said rectilinear guide means so as to be guided by said rectilinear guide means and thereby be able to convey said at least one closure rib along said rectilinear guide means by pulling on said leading end portion of said at least one closure rib and thereby accurately positioning said at least one closure rib at a predetermined position with respect to said film.

2. A machine as set forth in claim 1, further comprising:

said film conveying means comprises pay-out means for feeding said film in a planar state;

forming means for receiving said film in said planar state from said pay-out means and for forming said film into a tube;

a filler chute fluidically connected to said tube for conducting a product to be packaged into said tube;

means for conveying closure ribs transversely with respect to the longitudinal extent of said film as fed by said pay-out means in a longitudinal direction and for fixing said closure ribs to said film at a position upstream of said forming means;

longitudinal heat-sealing means for closing said tube longitudinally; and means for sequentially generating a first transverse sealing line upon said tube before a product is conducted into said tube by said filler chute, and for generating a second transverse sealing line upon said tube after a product has been conducted into said tube by said filler chute so as to close said film package around the product.

3. A machine according to claim 1, further comprising:

means for fixing closure ribs upon said film:

means for conveying said film fitted with said closure ribs toward a forming means for automatically forming said film fitted with said closure ribs into a tube;

means operatively connected to said film tube for filling said film tube with a product; and means for closing said film tube, filled with a product, so as to form a film package.

4. A machine according to claim 3, wherein said means for fixing said closure ribs comprises:

first means for fixing one of two mutually engageable complementary ribs, each one of a length that is approximately equal to one half of the width of said film, to said film at a position upstream of said forming means; and second means for fixing a second one of said closure ribs to an inside wall portion of said film once said film has been shaped into said tube so as to form a bag, after said bag has been filled with a product, and while said bag is being finished.

5. A machine according to claim 1, wherein the two closure ribs are carried by support strips of different widths.

6. A machine according to claim 5, wherein:

said support strip for said second one of said closure ribs is wider than said support strip for said first one of said closure ribs that is fixed to said film at said position upstream of said forming means.

7. A machine according to claim 3, further comprising:

means for conveying said closure ribs so as to fix a set of said closure ribs, covering the entire width of said film, to said film such that said set of closure ribs comes into engagement with each other only after said tubular film has been folded over and pressed shut, after said package has been filled, and while said package is being finished.

8. A machine according to claim 1, wherein the rectilinear guide means is formed by a rigid rectilinear channel.

9. A machine according to claim 1, wherein the rectilinear guide means is constituted by a channel formed by pivoting jaws suitable for opening so as to facilitate releasing the ribs.

10. A machine according to claim 1, wherein the grasping means are constituted by a clamp system controlled to open and close.

11. A machine according to claim 1, wherein the grasping means comprise a suction head.

12. A machine according to claim 1, in which the grasping means comprise a needle associated with means adapted to displace said needle back and forth towards and away from the rectilinear guide means so as to engage the rib when close thereto and to move the needle back and forth along the guide means so as to bring the closure rib into position by pulling on its leading end.

13. A machine according to claim 1, wherein means are provided for transversely displacing the grasping means synchronously with displacement of the film.

14. A machine according to claim 1, wherein means are provided for cutting the ribs into predetermined lengths.

15. A machine according to claim 4, wherein the means for fixing the closure ribs on the film are formed by heat-sealing jaws.

16. A machine according to claim 2, including means suitable for forming at least one precut line between the closure ribs and the second transverse line of sealing.

17. A machine according to claim 1, including means suitable for performing curved "coat-hanger" type longitudinal heat-sealing, in particular for applications in which the packaging contains a liquid.

18. A machine according to claim 2, including means suitable for forming longitudinal folds in association with the film prior to entering said forming means, so as to form packages having lateral gussets.

19. A machine according to claim 1, including means suitable for feeding asymmetrical and complementary male/female closure ribs.

20. A machine according to claim 1, including:

means for feeding closure ribs of constant section whereby corresponding portions of said closure ribs engage each other after said film has been folded over.

21. A machine according to claim 5, wherein the ribs are adapted to define a melting temperature on the outer surfaces of their support strips that is lower than the melting temperature on the inner surfaces thereof.

* * * * *